United States Patent [19]

Becker

[11] Patent Number: 4,540,352

[45] Date of Patent: Sep. 10, 1985

[54] PENDULAR PISTON PUMP HAVING A CUP-SHAPED SEALING ELEMENT

[76] Inventor: Erich Becker, Glöcklehofweg 13, D-7812 Bad Krozingen, Fed. Rep. of Germany

[21] Appl. No.: 531,722

[22] Filed: Sep. 9, 1983

[30] Foreign Application Priority Data

Sep. 11, 1982 [DE] Fed. Rep. of Germany ..... 3233854
Dec. 17, 1982 [DE] Fed. Rep. of Germany ..... 3246782

[51] Int. Cl.[3] ..... F04B 21/02; F16J 9/08

[52] U.S. Cl. ..... 417/571; 92/240; 92/243; 92/244

[58] Field of Search ..... 417/555 R, 559, 569, 417/571; 92/172, 182, 240, 242, 243, 244; 277/212 R, 212 C

[56] References Cited

U.S. PATENT DOCUMENTS

| | | | |
|---|---|---|---|
| 2,284,645 | 6/1942 | Duffy | 417/539 X |
| 2,985,358 | 5/1961 | Lee et al. | 417/490 |
| 3,848,518 | 11/1974 | Martin | 92/240 X |
| 3,961,869 | 6/1976 | Droege, Sr. et al. | 417/555 R |
| 4,028,015 | 6/1977 | Hetzel | 417/555 R |
| 4,039,270 | 8/1977 | Hiraga | 417/569 |
| 4,396,363 | 8/1983 | Sakamaki et al. | 417/571 X |

FOREIGN PATENT DOCUMENTS

| | | | |
|---|---|---|---|
| 195787 | 2/1958 | Austria | 92/240 |
| 1005224 | 10/1951 | France | 92/240 |
| 1357961 | 6/1974 | United Kingdom | 417/489 |
| 2045387 | 10/1980 | United Kingdom | 92/240 |
| 2073845 | 10/1981 | United Kingdom | 92/240 |

*Primary Examiner*—William L. Freeh
*Assistant Examiner*—Paul F. Neils
*Attorney, Agent, or Firm*—Peter K. Kontler

[57] ABSTRACT

A pump comprises a housing member bounding an elongated cylinder bore, a piston member received in the cylinder bore for reciprocation substantially longitudinally thereof, a drive for the piston member, and a sealing arrangement between the piston member and the housing member. The sealing arrangement includes at least one sealing element having a radial supporting section and at least one lip section sealingly contacting the housing member. The wall thickness of the supporting section exceeds that of the lip section. The sealing arrangement may further include another lip section pointing in the opposite direction counter to that of the one lip section, either provided integrally on the same sealing element or separately on a discrete second sealing element assembled with the initially mentioned sealing element to form the sealing arrangement. When the piston member carries out a pendular movement, the cross section or diameter of the cylinder bore is reduced toward and in the axially central region thereof as compared with the diameter at the axial ends of the bore, to reduce the width of the radial gap which the sealing arrangement has to bridge.

11 Claims, 10 Drawing Figures

101
4
13
14
16
7
15
b
9
210
D1
11
10
111
12
d
2
112a
22
23
111
D2
110
19
112
3
13
13
10
20
21
110
5
6

PENDULAR PISTON PUMP HAVING A CUP-SHAPED SEALING ELEMENT

BACKGROUND OF THE INVENTION

The present invention relates to pumps in general, and more particularly to pendular piston pumps.

There are already known various constructions of pumps for pumping liquids or gases, among them such using a pendular piston, that is, a piston which carries out a pendular movement as it reciprocates in its cylinder bore. In the known pumps, it is customary to use sealing means for sealing the piston in its associated cylinder bore, so as to sealingly separate a pumping chamber from the remainder of the internal space of the housing of the pump. Such sealing means may include a substantially cup-shaped or dish-shaped sealing element which includes a substantially radially extending support section or region at least partially supported on the piston, and a lip section or region which extends from the support region and sealingly contacts the internal surface of the pump housing within the cylinder bore.

In pumps or compressors of conventional construction the plunger piston and the connecting rod acting thereon so as to move the piston to and fro in the axial direction of the cylinder bore are constructed as two separate parts which are connected with one another by means of a piston bolt. What is disadvantageous in this conventional construction is that the piston bolt and the lubricating arrangement needed for lubricating the same are situated at a relatively hot zone of the pump. From this, there result, among others, problems with respect to the lifespan of the lubricant for the lubrication of the piston bolt. Furthermore, lateral guidance forces come into existence between the aforementioned plunger piston and the internal surface of the housing that bounds the cylinder bore for the piston, so that usually guidance rings are required for the piston Such piston rings constitute parts which are subjected to a significant amount of wear.

In order to avoid these disadvantages of the conventional pumps employing a plunger piston, there have been already developed so-called pendular piston pumps. In such pumps, the piston proper and the connecting rod therefor are of one piece and constitute a piston member. Because of the resulting rigidity of the piston member, that is, the absence of the articulate connection between the connecting rod and the piston proper, the piston shares the pendular movement of the piston rod as the latter is being moved by a crank drive, while the piston simultaneously reciprocates in the cylinder bore of the housing. A particular danger encountered in connection with such pendular piston pumps is the possibility of leakage of the medium being pumped past the piston, owing to the tilting movement of the piston with the connecting rod. This danger is especially pronounced at and around the central position of the piston within its stroke, that is, intermediate the two axially spaced reversing positions, where the piston is inclined or tilted the greatest extent relative to the longitudinal axis of the cylinder bore. In heretofore proposed pendular pistons (see, for instance, U.S. Pat. No. 3,961,869), this potential drawback is at least substantially avoided by providing the pendular piston with an annular substantially cup-shaped or dish-shaped seal.

However, even such pumps possess significant drawbacks. Usually, the annular seal of the prior art is punched out of elastic or deformable plates (often Teflon plates). Hence, the annular seal has the same wall thickness at its lip region which contacts the internal surface of the housing within the cylinder bore as at its support region which extends substantially radially outwardly from the piston and is at least partially mounted on the latter. As a result of this configuration, the known sealing elements do not offer a sufficient resistance to be able to laterally support the piston in the associated cylinder bore. Moreover, at least theoretically, the pressure of the medium being pumped, such as gas, does not exert any lateral guidance forces on the pendular piston, in that such pressure always acts in the direction of the axis of the connecting rod of the pendular piston member. Yet, in practice, at least some lateral guidance forces, albeit minute, still exist in the environment of the conventionally constructed pendular piston. Such small lateral guidance forces are caused primarily by friction and inertia.

It will be appreciated that the non-existent or insufficient lateral guidance and support of the pendular piston member in the associated cylinder bore results in premature or excessive wear of the lip region of the annular seal. Also, there exists the danger that, because of the thinning of the lip region as a result of the wear of the latter, the "lower" piston part which is situated "downwardly of" the sealing element could come into contact with the surface bounding the cylinder bore and and cause damage thereto. It is to be understood that expressions such as "lower" or "downwardly of" are being used herein, to means closer to the crankcase of the pump, regardless of the position of the pump in space.

OBJECTS AND SUMMARY OF THE INVENTION

An object of the present invention is to construct a pendular piston pump in such a way that it is substantially leakage-free, irrespective of the forces acting on the piston member and the position of the piston in the cylinder bore.

It is another object of the present invention to develop a pump of the above-mentioned type in which a good guidance is provided for the piston member in the cylinder bore receiving the same.

A concomitant object of the present invention is to design the pump of the above type in such a way that it is of simple construction, inexpensive to manufacture, easy to use, and reliable in operation.

One feature of the present invention resides in the position of a pump comprising a housing member having an internal surface bounding an internal space including at least an elongated cylinder bore having a longitudinal axis; a piston member received in the cylinder bore; means for moving the piston member in the cylinder bore substantially along the longitudinal axis; and means for sealing the piston member in the cylinder bore, such sealing means including at least one sealing element having a substantially radially extending supporting section or region at least partially mounted on the piston member, and a lip second or region sealingly contacting the internal surface in the cylinder bore, the wall thickness of the substantially radially extending support region exceeding that of the lip region of the sealing element. This expedient finds a particularly good use in a pump in which the moving means includes a crank drive and the piston member includes a piston and a connecting rod rigid with the piston and articulated to the crank drive such that the piston member carries out a pendular movement during the operation of the crank drive as the piston moves along the longitudinal axis of the cylinder bore.

By resorting to this expedient, there is obtained the advantage, on the one hand, that there is obtained a sufficiently strong support and guidance for the pendular piston member in any of its tilted positions during the movement of the piston member axially of the cylinder bore during the pumping stroke, as well as during the suction stroke. On the other hand, there is obtained the advantageous and desirable sealing engagement of the lip region of the sealing element with the internal surface within the cylinder bore, again in any of the positions of the piston member, in the manner of a self-sealing lip seal.

It has been established that one cannot increase the wall thickness of the entire sealing element throughout, that is, both at the substantially radially extending support region and at the lip region, in order to, for instance, obtain the desired increased wall thickness of the radially extending support region for performing the piston guiding function expected from such support region. This is so because a simple wall thickness increase of the sealing element in its entirety also results in an increase of the wall thickness of the lip region, which results in a situation where the lip region is no longer capable of sealingly hugging or contacting the internal surface of the housing member in the cylinder bore.

It has been determined that it is advantageous, in accordance with the present invention, that the maximum wall thickness of the lip region of the sealing element amount to substantially 0.6 millimeter. When this expedient is being used, the lip region is capable of sealingly hugging or following the internal surface of the housing member within the cylinder bore during the entire stroke of the piston member as the latter performs its pumping function, so that leakage of the medium being pumped past the sealing element is avoided. This is particularly important in pumps with pendular piston members in order to avoid the possibility of breakdown of the self-sealing effect and thus damage or destruction of the pump.

Advantageously,the sealing element has a substantially cup-shaped configuration, and the lip region extends at least partially radially beyond the support region of the sealing element It is further advantageous to ensure that the sealing element include a third or transition section or region situated between the support region and the lip region, the transition region mounting the lip region on the support region for tilting relative thereto. It is especially advantageous for the transition region to have a groove therein that extends circumferentially of the sealing element between the support and lip regions to facilitate tilting of the lip region relative to the support region by weakening the sealing element at the transition region and hence improving its function as a hinge for the lip region. According to the present invention, it is further proposed for the housing member to include a main portion and a cover portion connected to the main portion and bounding a pumping chamber in the cylinder bore, together with at least the piston member, the cover portion being detachable from the main portion to provide for access to the sealing element for replacement purposes or the like. A particularly advantageous construction of the piston, according to the present invention is obtained when the piston member includes a support portion situated at the opposite side of the sealing element from the pumping chamber and supporting the sealing element on the piston member, and a confining portion situated in the pumping chamber and confining the sealing element between itself and the support portion of the piston member. Then it is advantageous that the support portion of the piston member have a diameter exceeding that of the confining portion.

According to another advantageous concept of the present invention, which can be used by itself or in combination with the above-discussed features of the present invention, the elongated cylinder bore has at least one diametric dimension which varies from its smallest magnitude at the axially central region of the cylinder bore toward its largest magnitude at the axial ends of the cylinder bore. In other words, the cylinder bore is somewhat narrower at its central portion than at its ends. At this central region, the piston member or the piston thereof assumes its position which is tilted to the greatest extent relative to the longitudinal axis of the cylinder bore because of the pendular motion of the piston with the connecting rod so that, if the cylinder bore had a constant circular diameter over its entire axial length, as it does in pumps of conventional construction, the distance between the piston member and the internal surface of the housing member that bounds the cylinder bore, which distance is to be bridged by the sealing means, would be at its greatest. As a result of the aforementioned expedient of making the cylinder bore narrower at the central region than at the ends, it is achieved that this distance is somewhat lessened, with beneficial effect on the quality of the sealing action of the sealing means.

Advantageously, the one diametric dimension gradually varies in dependence on the pendular motion of the piston in the bore, in such a manner, especially, that the circumference of the imaginary ellipse corresponding to the respective tilted position of the piston and bounding the zone of the cylinder bore at which the piston assumes the respective tilted position, substantially corresponds to the circumference of the cylinder bore at the zones thereof at which the piston is situated when reaching the respective ends of its stroke.

It has been established that, in conventional pumps with pendular piston member, a considerable amount of undesirable noise is generated. Experiments have established that this noise generation is especially the result of flow of ambient air during the suction stroke from the crankcase space past the sealing lip of the sealing element and into the pumping chamber. During this mode of operation, sections of the lip region are somewhat lifted from the internal surface and later return into contact with the internal surface, which generates the aforementioned noise. Hence, it is an additional object of the present invention to devise a pump, especially a pendular piston pump, in which the generation of undesirable noise is reduced to a minimum, if not eliminated altogether.

This additional object of the present invention is achieved in a manner which can be used by itself or in combination with any or all of the above-mentioned features of the present invention, in that the sealing means includes a first lip region that extends from the support region toward the pumping chamber and sealingly contacts the internal surface of the housing member in the cylinder bore, and a second lip region extending from the support region away from the pumping chamber and toward the remainder of the internal space of the housing member, this second lip region also sealingly contacting the internal surface of the housing member in the cylinder bore. In this manner, the flow of air from the crankcase space into the pumping chamber is at least largely prevented. Accordingly, the pendular piston members of this construction, that is, equipped with sealing means of this configuration, can operate quite silently.

An especially advantageous construction of the sealing means according to this aspect of the present invention resides in that the sealing means includes two sealing elements arranged next to one another on the piston member and one having the first, and the other the second lip region, each of the sealing elements having its own substantially radially extending central portion connected with the respective lip region and together constituting the support region of the sealing means. In this manner, there is obtained a particularly simple construction of the pendular piston pump and especially of the sealing means thereof, especially when the two sealing elements have the same dimensions, and when at least one of the sealing elements, but preferably both of them, have the same wall thickness throughout, that is, at the radially extending central region as well as at the respective lip region. However, according to another aspect of the present invention, it is advantageous when the sealing element includes a single one-piece sealing element having the substantially radially extending support region as well as the first and second lip regions. Regardless of whether the sealing element is of one piece or whether two separate sealing elements are provided to constitute the sealing means, it is advantageous that the support and lip regions be so constructed that the lip regions delimit with one another and with the internal surface bounding the cylinder bore a labyrinth-type sealing compart ment of annular configuration which is substantially enclosed with respect to the environment of the pump as well as with respect to the pumping chamber and the remainder of the internal space.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
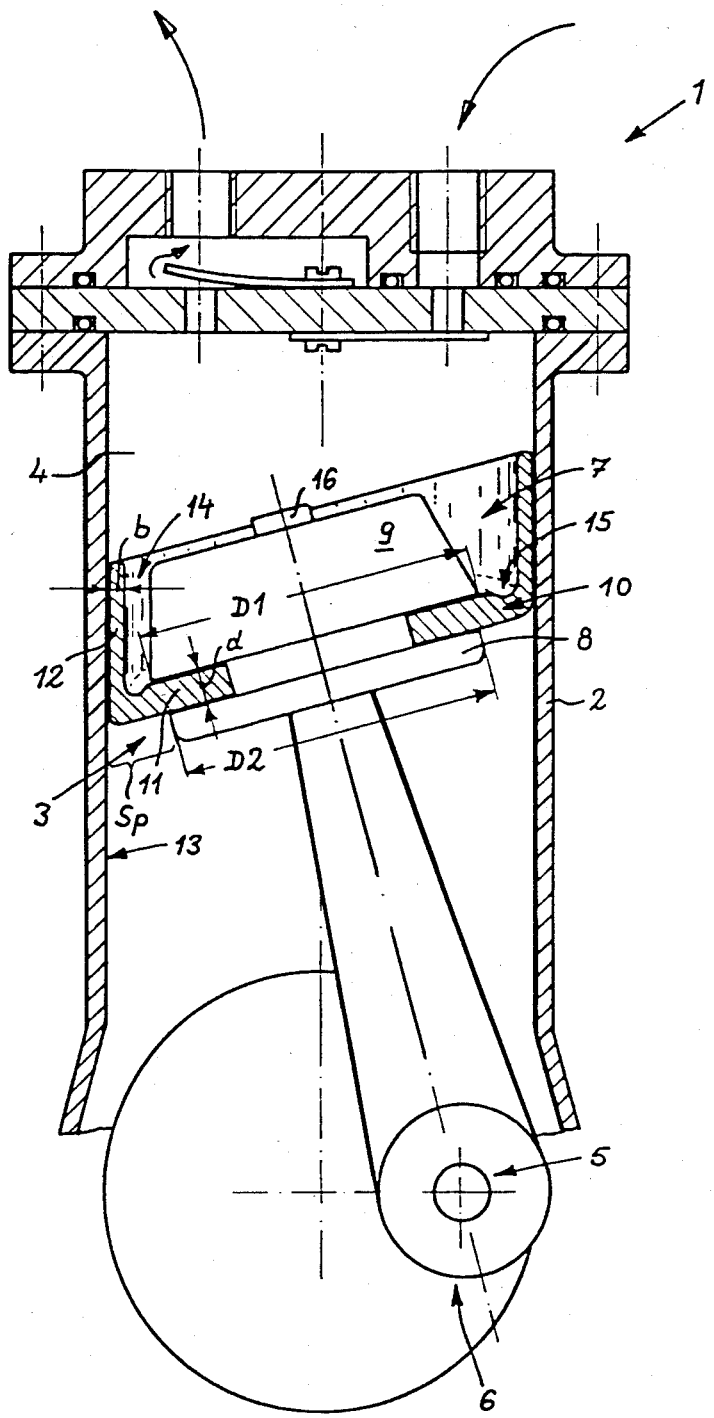
FIG. 1 is a fragmentary sectional view of a pendular piston pump embodying the present invention.

Referring now to the drawing in detail, and first to FIG. 1 thereof, it may be seen that the reference numeral 1 has been used to identify a pendular piston member pump in its entirety. The pump 1 includes a housing member 2 which bounds an internal cylinder bore in which a piston member 3 is guided for reciprocation along the axis of the cylinder bore. The cylinder bore includes a pumping chamber having a volume that varies as the pendular piston member 3 carries out its movement, this pumping chamber being identified by the reference numeral 4. The piston member 3 is provided at its end portion remote from the pumping chamber 4 with a connecting rod bearing 5 which is articulately or tiltably connected to a mounting portion 6 of a crank member of a crank drive or shaft, the mounting portion 6 being eccentric relative to the axis of rotation of the crank member.

Figure 2:
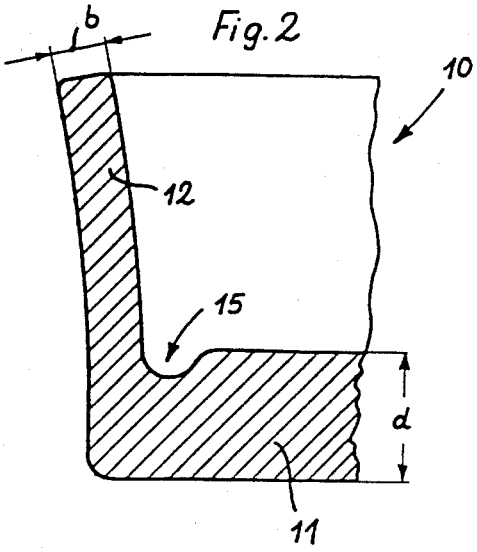
FIG. 2 is an enlarged fragmentary axial sectional view of a sealing element which can be used in the pump of FIG. 1.

The pendular piston member 3 includes a piston 7 proper that includes a support portion 8 as well as an upper confining portion 9 which is removably secured to the support portion 8. A sealing element of a substantially cup-shaped configuration, indicated at 10, is confined between the support and confining portions 8 and 9. The sealing element 10 has a substantially radially supporting section or support region 11, and a lip section or 12. According to the present invention, the support region 11 of the sealing element 10 has a thickness d which is greater than the wall thickness b of the lip region 12 of the sealing element 10. In this manner, there is obtained a good sealing contact of the lip region 12 with the internal surface 13 of the housing member 2, even though or because the lip region 12 is relatively thin. At the same time, there is obtained a strong guidance for the piston member 3 in the cylinder bore of the housing member 2, due to the presence of the relatively thick support region 11. This can be easily ascertained from a comparison of FIGS. 1 and 2.

The maximum wall thickness b of the lip region 12 of the sealing element 10 is to approximately 0.6 millimeter. When the sealing element 10 is made of a material which is bendable or flexible but not particularly yieldable or elastic, such as, for instance, of polytetrafluoroethylene, there is obtained, when the wall thickness b of the lip region 12 is 0.6 millimeter or less, a still sufficient hugging or conforming capability on the part of the lip portion 12 with respect to the internal surface 13, so that the sealing element 10 can operate in the manner of a self-sealing lip seal. To achieve this purpose, an annular gap 14 is provided between the upper piston portion 9 having the diameter D1 and the internal diameter of the lip region 12. Medium being pumped, which is at an elevated pressure, penetrates into this gap 14 and provides for pressing the sealing lip region 12 against the internal surface 13 of the housing member 2 in each position of the pendular piston member 3.

In the construction depicted in FIG. 1, the sealing element 10 is of one piece and has a substantially cup-shaped or dish-shaped configuration with an increased-thickness bottom region 11 which constitutes the above-mentioned substantially radially extending region 11 in the mounted position of the sealing element 10 on the piston 7. This can best be seen in FIG. 2 which also shows that, in the relaxed or non-deformed condition of the sealing element 10, the lip region 12 of the latter extends slighly radially outwardly beyond the outline of the support region 11, so that, in the first instance, deformation forces associated with the bending of the lip region 12 inwardly on mounting of the piston 7 in the cylinder bore, provide for initial pressing of the lip region 12 into sealing contact with the internal surface 13 of the housing member 13, even when no fluid pressure acts on the sealing element 10 or the lip region 12 thereof. The sealing element 10 further includes a third section or transition region interposed between the support region 11 and the lip region 12. This transition region is constructed as a hinge of sorts in that it permits slight pivoting or tilting of the lip region 12 about the same relative to the support region 11. This is rendered possible, preferably, or enhanced or faciliatated, by providing the transition region with a transition groove 15 extending in the circumferential direction at the transition region between the support region 11 and the lip region 12 of the sealing element 10.

The upper confining portion 9 is dismountably mounted on the remainder of the pendular piston member 3 by means of a screw 16. Because of this, the sealing element 10 can be removed from the piston member 3 from the side of the pumping chamber 4, for instance, to be replaced by a new one, after the screw 16 and the upper confining portion 9 have been dismounted. The lower support portion 8, which holds the sealing element 10 in position in the downward direction, that is, toward the crankcase space, has a diameter D2 which is somewhat smaller than the diameter D1 of the upper confining portion 9 of the piston member 3. In this manner, the danger that the support portion 8 could contact the internal surface 13 of the housing member 2 in a considerably tilted position of the piston member 3 and when the sealing element 10 has already under gone extensive wear and damage the same, is avoided. Such a construction of the support portion 8 with the reduced diameter D2 is possible because the radially extending support region 11 of the sealing element 10 has a correspondingly greater wall thickness d. This wall thickness d, which is greater than the wall thickness b of the lip region 12, has also the following advantage: When the lip region 12 is already worn out at places, the piston member 3 still retains a sufficient guidance on the internal surface 13 of the housing member 2, due to the presence of the radially extending support portion 11, so that the internal surface 13 of the housing member 2 does not suffer any damage. However, because of the damage to the lip region 12 under such circumstances, the pump 1 does not perform its pumping function any more; thus, the pump 1 announces, in a way, itself that its sealing element 10 has to be replaced, before the occurrence of any mechanical damage, especially to the internal surface 13 of the housing member 2.

Figure 3:
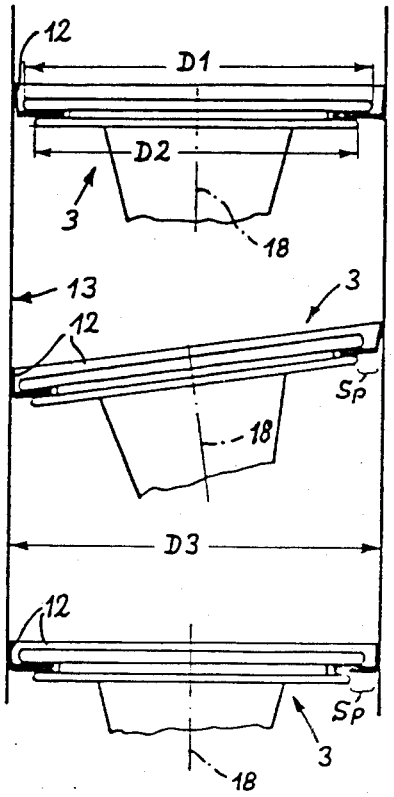
FIG. 3 is a diagrammatic representation of a constant-diameter cylinder bore with a pendular piston member received therein and shown in three different positions.
Figure 4:
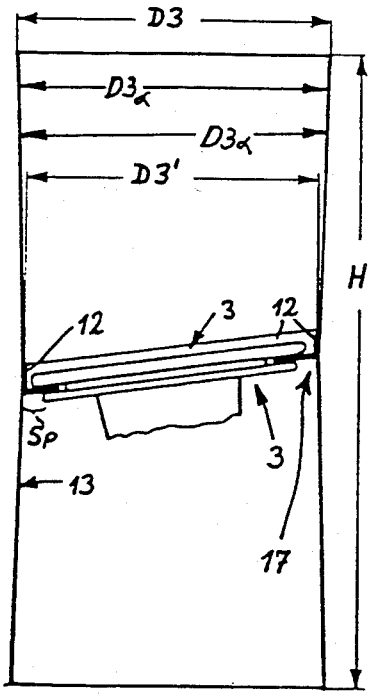
FIG. 4 is a view similar to that of FIG. 3 but with the cylinder bore somewhat narrowed in the central region and with the pendular piston member shown in only one position thereof at the central region.

According to another concept of the present invention, the internal dimension or diameter D3 of the cylinder bore of the pump housing 2 is reduced, at least in one diametric direction, to D3' at a central region 17 of the cylinder bore, as seen particularly in FIG. 4. The advantage obtained by using this expedient will become apparent particularly from the comparison of FIGS. 3 and 4. FIG. 3 shows diagrammatically the pump cylinder or housing member 2. The piston member 3 is depicted in the cylinder bore of the housing member 2 in three different positions. In the upper and lower positions, in which the piston member 3 is at the respective ends of its stroke, the central axis 18 of the piston member 3 practically coincides with the longitudinal axis of the cylinder bore. When the diameters D1 and D2 of the respective upper confining portion 9 and the lower support portion 8 are selected to fit to the diameter D3 of the cylinder bore of the housing member 2, the sealing element 10 needs only to bridge a relatively narrow radial gap between its mounting zone on the pendular piston member 3 and the internal surface 13 of the housing member 2 when the piston member 3 is at its upper and lower reversing positions. In contrast thereto, this radial gap becomes relatively large when the piston member 3 is in its central position in which it assumes a tilted position due to the pendular movement of the piston member 3, and the cylinder bore of the housing member 2 has a constant diameter 3 over its entire axial length, as it does in FIG. 3. This increased gap Sp, which is to be bridged by the sealing element 10, is reduced according to the present invention, as shown in FIG. 4, in that the cylinder bore becomes narrower or is slenderized from the axial ends toward the central region 17, that is, the cylinder bore of the housing member 2 has a slightly smaller diameter D3' at the central region 17. This reduction of the inner diameter from D3 to D3' conforms to the tilted position of the piston member 3 at the particular region of the cylinder bore of the housing member 2. Advantageously, the diameter of the cylinder bore of the housing member 2 is the same in all diametric directions, that is, the cylinder bore has a circular configuration at each elevation thereof. However, the effect of the reduction of the gap Sp is most pronounced in the plane of the pendular motion of the piston member 3, which corresponds to the plane of FIGS. 3 and 4 of the drawing. On the other hand, no increase in the size of the gap occurs in the plane normal to that of FIG. 3 of 4, regardless of the extent of tilting of the piston member 3. Because of the narrowing of the cylinder bore toward the central region 17, all the way to the diameter D3', the lip region 12 of the sealing element 10 is slightly deformed inwardly at the region of the plane normal to that of the drawing. Because of this, the annular sealing lip region 12 of the sealing element 10 can even more easily bridge the gap Sp between the pendular piston member 3 and the internal surface 13 of the housing member 2 in the vicinity of the tilting plane S of the pendular motion of the piston member 3, even though this gap Sp may be somewhat increased in this vicinity. For the sake of clarity, the reduction of the internal diameter from D3 to D3' is shown in FIG. 4 in a slightly exaggerated manner.

Figure 5:
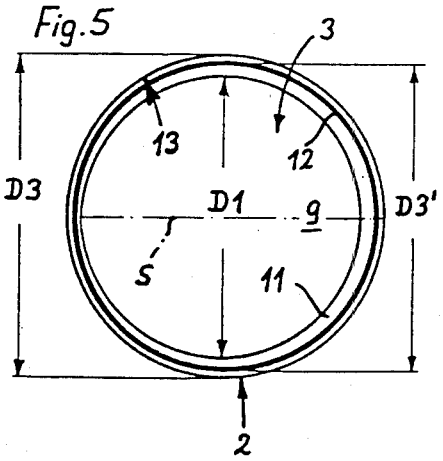
FIG. 5 is a diagrammatic plan view of the structure which is shown in FIG. 4.

When speaking about the central region 17, reference is being has to the intermediate region situated between the end regions of the stroke H of the piston member 3 or of the piston 7 thereof. The stroke H is also shown in FIGS. 3 and 4 in an exaggerated manner. FIG. 5 shows the piston member 3 in its tilted position corresponding to that of FIG. 4 in a view from above into the cylinder bore of the housing member 3 which is narrowed as described above.

The pump 1 of the present invention is capable of operation not only in the same range of operating conditions as the conventional pumps of a similar construction, which is, in practice, between about 20 liters per minute and approximately 100 liters per minute, but also in a much wider range of operating conditions from about the aforementioned 20 liters per minute all the way up to approximately 200 liters per minute and in some instances up to 500 liters per minute of the volume being pumped. Herein, the pendular piston member pump 1 can especially operate as a dry running pump. This term is intended to donate pumps in which the piston member runs in the cylinder bore without any lubrication whatsoever. This has the advantage that no lubricant comes into contact with the medium being pumped. The media which can be pumped by the pump 1 of the present invention include liquids as well as gaseous media.

The expedients described so far can be used individually or in combination with one another. The tilted position of the pendular piston member 3 is shown in the drawing, especially in FIG. 1, in an exaggerated manner, for a better overview of the principles involved here. The same is true for the radial dimension of the gap Sp in FIGS. 3 to 5.

According to a special construction of the present invention, the internal diameter D3α of the pump cylinder bore of the housing member 2 so varies in dependence on the extent of the stroke H of the piston member 3 so that, in each tilted position of the latter corresponding to the angular position α of the crank drive or member, the circumference of the imaginary ellipse corresponding to the respective tilted position of the piston member 3 or the piston 7 thereof at least substantially corresponds to the circumference of the cylinder bore of the housing member 2 in the upper or lower reversing position of the piston 7. The geometric relationships will be explained below on the basis of the illustration of FIG. 6.

When the internal diameter D3 is varied over the stroke H of the piston 7 in the above-indicated manner, there is obtained the following: the (theoretical) circumference of the lip region 12 of the sealing element 10 can remain at least substantially constant for all positions of the piston 7 in the cylinder bore of the housing member 2. The slenderizing of narrowing of the cylinder bore of the housing member 2 is so varied, in dependence on the respective position of the crank member or the respective angular position of the crank drive, that the lip region 12 needs to change from its circular shape assumed when the piston 7 is in its upper or lower position merely in various elliptical shapes, as the piston 7 with the sealing element 10 thereon passes toward and through the central region 17 of the stroke H; herein, the circumferential length of the lip region 12 needs, for all intents and purposes, not change. In other words, when the internal diameter D3 α is properly chosen over the entire stroke length in dependence on the position of the crank drive and thus of the piston member 3, it is achieved that the lip region 12 has the shape of a circular ring in the upper and lower reversing positions of the piston member, this circular ring having a predetermined circumferential length, and that this circular ring has to change, while retaining its circumferential length during the travel of the piston member 3 in its trajectory of motion, only various ellipses which, however, practically always have substantially the same circumferential length. Accordingly, the stressing of the lip region 12 of the sealing element 10 is relatively low. It is also possible, advantageously, to use a material with relatively low flexibility for the sealing element 10 and, especially, longer stroke lengths than before are possible for the piston member 3 of the pump 1, without causing excessive deformation of the sealing element 10 or, worse yet, formaticn of leakage zones at the sealing element 10.

Figure 6:
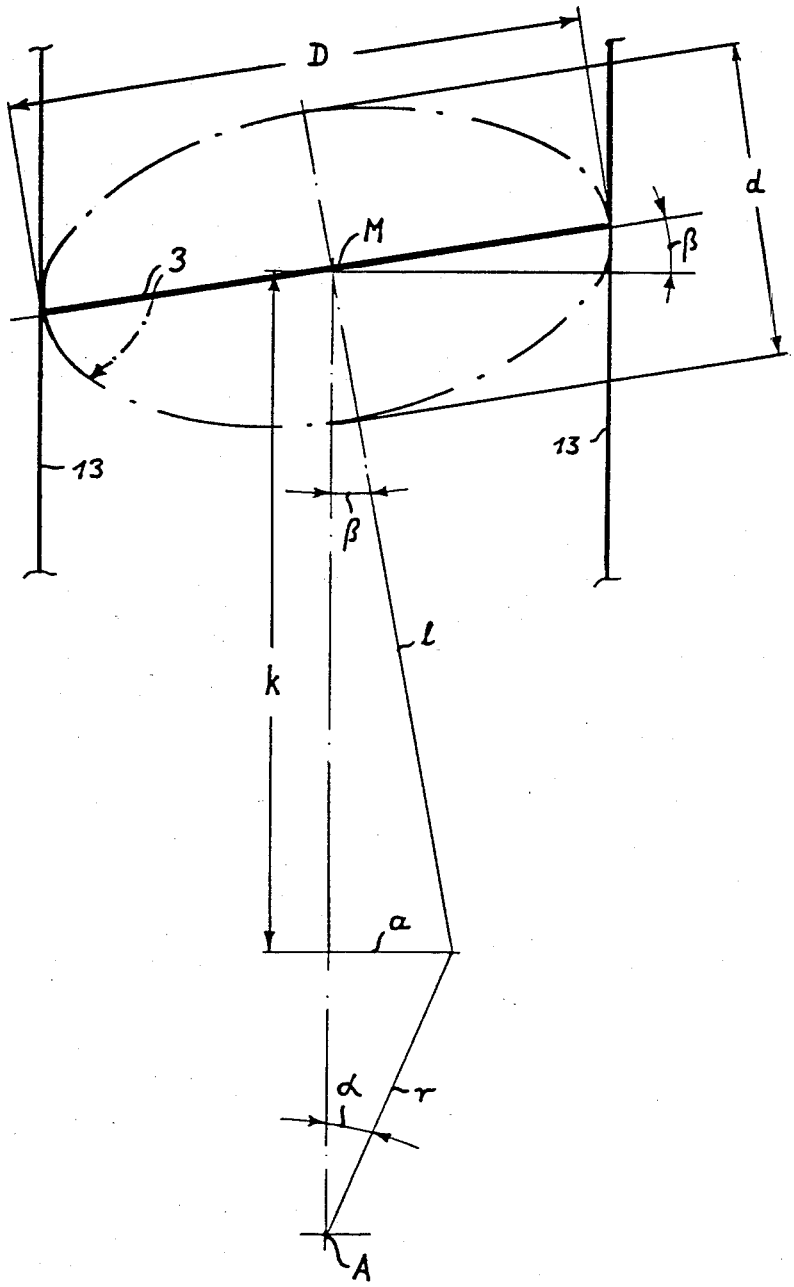
FIG. 6 shows the geometric relationships in the pump of FIG. 1 when the piston member is in its tilted position.

In FIG. 6 and in the following derivation of the diameter D3α, the following reference characters have the following meanings:

l=connecting rod length r=crank drive eccentricity

α=angular position of the crank drive from the upper reversing position

β=angle of inclination of the piston relative to its position in the upper reversing position k=projection of the connecting rod length into the shortest distance between the central point of the piston M and the crank drive axis A K=theoretical diameter of the sealing lip.

K corresponds to the diameter D3 of the cylinder bore of the housing member 2 in the upper and lower reversing positions of the piston member 3. In any inclined position of the pendular piston member 3, the sealing lip region 12 takes the shape of an ellipse with the circumferential dimension $U_E$. Herein, the following obtains:

$$U_E = \frac{\pi \cdot (D + d)}{2} = \pi \cdot k \qquad \text{(I)}$$

$$\sin \alpha = \frac{a}{r}$$

$$a = r \cdot \sin \alpha \qquad \text{(II)}$$

$$\cos \beta = \frac{k}{l} \text{ ; moreover}$$

$$k^2 = l^2 - a^2$$

$$\cos \beta = \frac{\sqrt{l^2 - a^2}}{l} = \frac{\sqrt{l^2 - r^2 \cdot \sin^2\alpha}}{l} \qquad \text{(III)}$$

moreover $$\cos \beta = \frac{d}{D} \qquad \text{(IV)}$$

$$\frac{d}{D} = \frac{\sqrt{l^2 - r^2 \cdot \sin^2\alpha}}{l}$$

From the equation (I), it follows:

d+D=2k

D=2k−d; when this is substituted into the equation (IV), it is obtained $$\frac{2k - d}{d} = \frac{l}{\sqrt{l^2 - r^2 \cdot \sin^2\alpha}}$$

$$\frac{2k}{d} = l + \frac{l}{\sqrt{l^2 - r^2 \sin^2\alpha}}$$

$$\frac{2k}{d} = \frac{l + \sqrt{l^2 - r^2 \cdot \sin^2\alpha}}{\sqrt{l^2 - r^2 \cdot \sin^2\alpha}}$$

-continued $$d = \frac{2k\sqrt{l^2 - r^2 \cdot \sin^2\alpha}}{l + \sqrt{l^2 - r^2 \cdot \sin^2\alpha}}$$

The last-mentioned expression or value "d" according to the illustration of FIG. 6 corresponds to the respective minor "diameter" or axis of the elliptically deformed sealing lip 12 with the relationships selected as mentioned above, and this in dependence on the crank drive angle $\alpha$. When now, correspondingly, the inner diameter D3$\alpha$ of the cylinder bore of the housing member 2 is made over the stroke length H in the above manner in accordance with the above equations and in dependence on the crank drive angle $\alpha$, the theoretical conditions for the sealing lip 12 to work with practically constant circumferential length in all tilted positions of the pendular piston member 3 are satisfied. However, in actual practice, the diameter D3 will be adjusted relative to the theoretically calculated one so as to obtain easy manufacture of the cylinder bore.

In the otherwise two-dimensional illustration of FIG. 3, the sealing region 12 of the tilted sealing element 10 is additionally shown in a perspective view, for the sake of elucidating the concepts of this expedient, in phantom lines.

Figures 7, 8, 9:
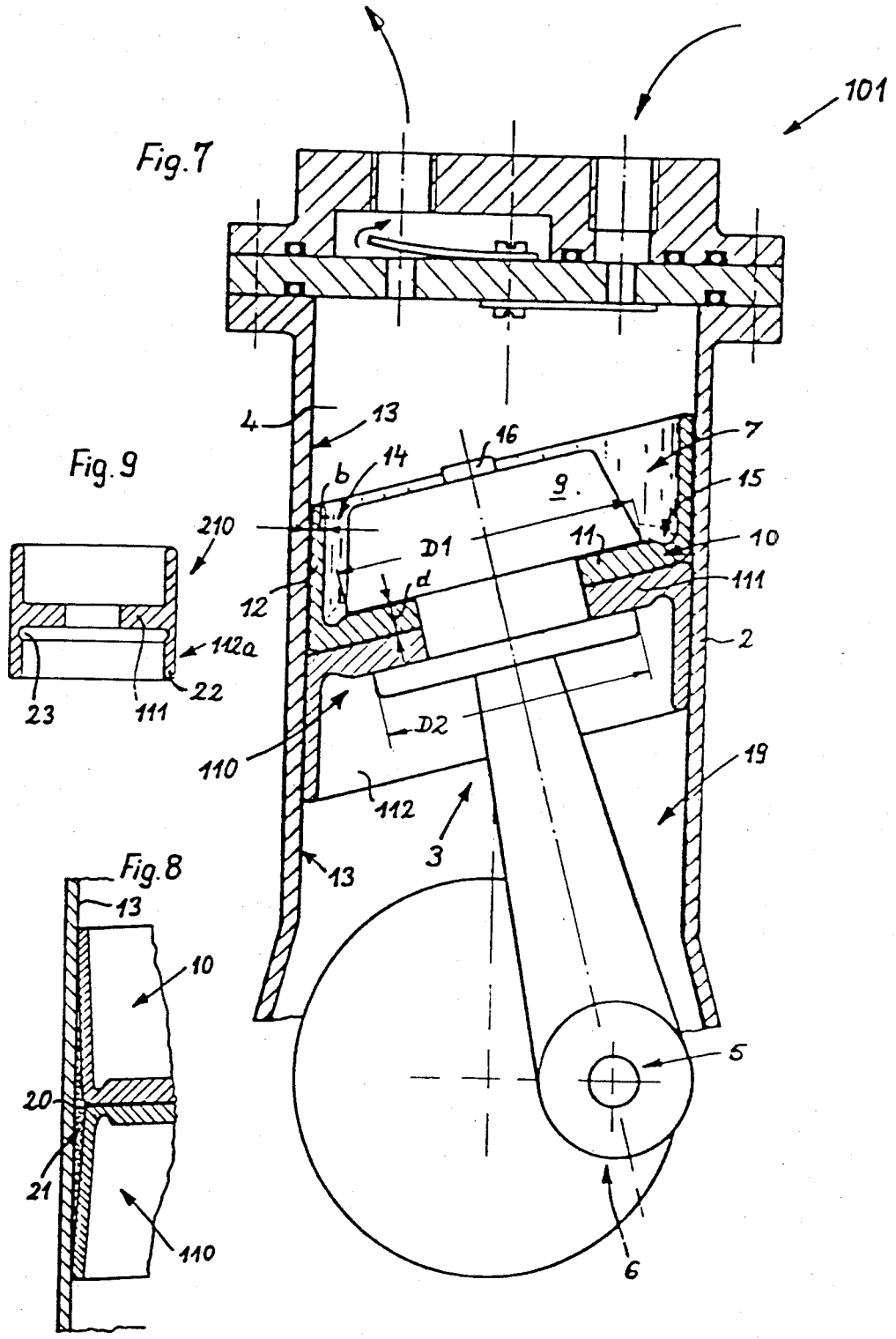
FIG. 7 is a view similar to that of FIG. 1 but showing a modification.
FIG. 8 is an enlarged axial sectional view of a lip section of the sealing arrangement of FIG. 7.
FIG. 9 is a smaller-scale axial sectional view, of a modified sealing arrangement for use in the pump of FIG. 7.

A further advantageous aspect of the present invention is illustrated in FIGS. 7 and 8. FIG. 7 shows a pump 101 that is similar in many respects to the pump 1 of FIG. 1. However, in deviation from the latter, the pump 101 contains a modification which can be used either alone or in combination with the other above-discussed features. This modification resides in that the sealing element 10 includes, below its radial support region 11, a second sealing lip region which extends in the direction toward the crankcase space 19. This is accomplished in the construction depicted in FIG. 7 in that, in addition to the initially described sealing element 10, there is further provided on the piston member 3 next to the sealing element 10 an additional sealing element 110 having a lip region 112 which extends away from the first-mentioned sealing element 10, that is, toward the crankcase space 19. During the suction stroke cf the pendular piston member 3, practically no air can flow from the crankcase space 19 past the lip region 12 into the pumping chamber 4 any longer. Undesirable lifting movements of the sealing lip region 12, and pump noises resulting therefrom, are thereby eliminated to the greatest extent possible. Experiments have shown that the pendular piston member pump 101 constructed in this manner works in an extremely silent manner.

A relatively simple production and a relatively simple part exchange or interchange are obtained when the two sealing elements 10 and 110 have the same dimensions, as also indicated in FIG. 7. Herein, it is also possible to use two sealing elements 10 and 110, in which the wall thickness d of the radial support region 11 or 111 corresponds to the wall thickness b of the respective lip region 12 or 112. More particularly, by the use of two of the sealing elements 10 and 110 in conjunction with one another, there is already obtained a reinforced or strengthened radial support and guidance, similarly to what has been previously described in connection with FIGS. 1 to 6. If need be, or if desired, the sealing element can also be made integral with the two sealing lip regions 12 and 112. So, for instance, the second lip region 112 can be constituted by a bulge of lip-shaped cross section which projects toward the crankcase space 19, and which fits easily into the housing member 2. As indicated especially in FIG. 8, a substantially enclosed annular compartment can be advantageously formed between the two lip regions 12 and 112, on the one hand, and the internal surface 13 of the housing member 2, on the other hand. In this manner, there is obtained during the operation of the pendular piston member pump 101 a sort of labyrinth seal. Any air which will still be able to leak past the lip region 112 extend ing toward the crankcase space 19, forms small eddies 21 which are illustrated in FIG. 8 in an exaggerated manner for the sake of clarity. In this manner, the energy of the leakage is dissipated and there is formed a labyrinth seal in the substantially enclosed compartment 20.

It has been found that, surprisingly, when the pendular piston member pump, such as 101, is provided with the two aforementioned sealing lip regions 12 and 112 as shown in FIGS. 7 and 8, it can be used for generating a relatively high vacuum. It is possible to achieve pressures below 100 torr by using the pump 101 of this construction. Consequently, a particularly advantageous use of the pendular piston member pump 101 as illustrated in FIGS. 7 and 8 is as a vacuum pump.

In FIG. 9, there is shown, on a scale considerably smaller than to that of FIG. 7, a one-piece sealing element. The lip region 112 pointing toward the crankcase space 19 is shortened to form a bulge 22. At its transition toward the radial support region 111, it is provided with a radially oriented groove 23, which facilitates the sealing engagement between the bulge 22 and the internal surface 13 of the housing member 2.

Figure 10:
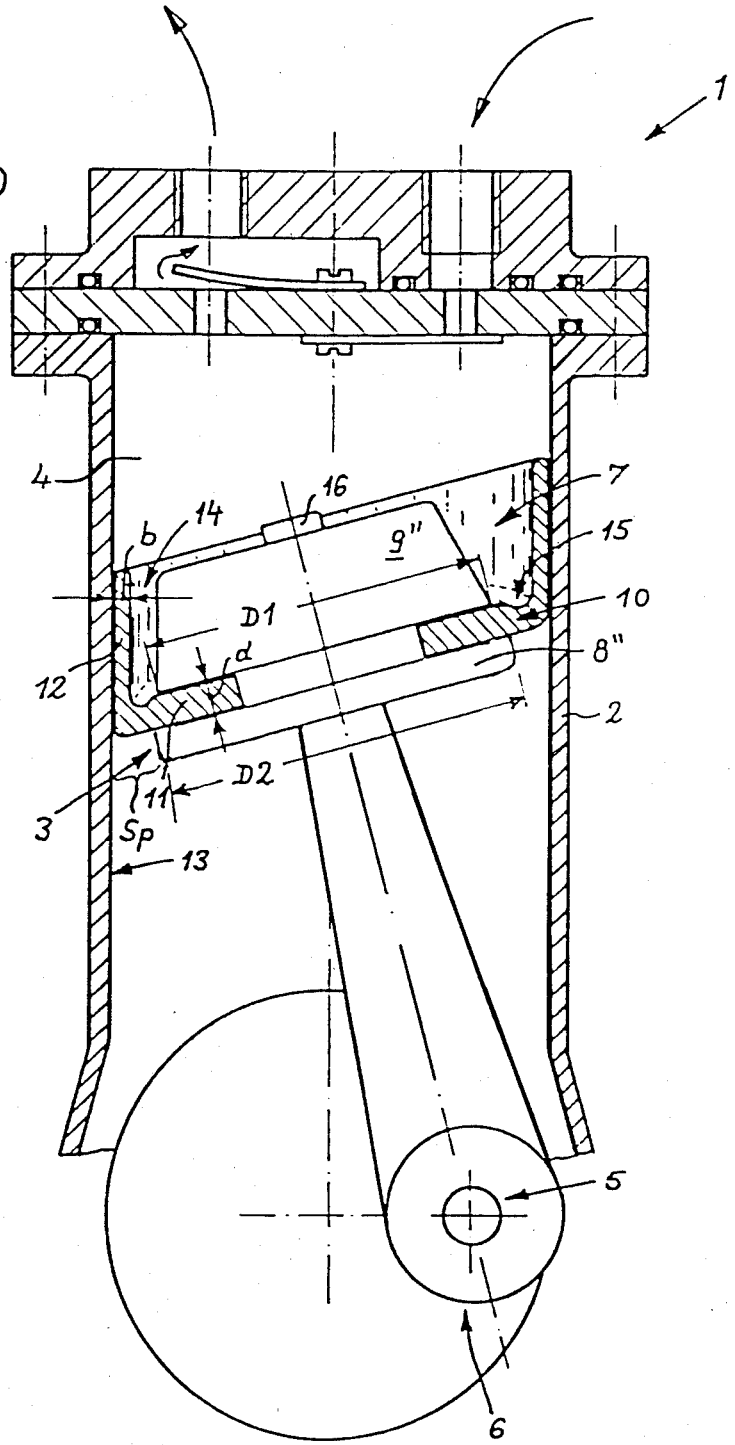
FIG. 10 is a view similar to that of FIG. 1 but showing a modification.

FIG. 10 shows that embodiment wherein the diameter of the support portion of 8'' of the piston member 3 exceeds the diameter of the confining portion 9''.

It will be understood that each of the elements described above, or two or more together, may also find a useful application in other types of arrangements differing from the type described above.

While the invention has been illustrated and described as embodied in a pump equipped with a pendular piston member, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of appended claims.

I claim:

1. A pendular pump comprising a housing member having an internal surface bounding internal space including an elongated cylinder bore; a pendular piston member movably received in said cylinder bore and delimiting a pumping chamber therein, said housing member having fluid inlet and fluid outlet means communicating with said pumping chamber during different stages of pendular movement of said piston member and said piston member including a piston and a connecting member rigid with said piston; means for moving said piston member in said cylinder bore so that said piston member performs a pendular movement axially of said cylinder bore, said moving means including a crank drive articulately connected to said connecting member so that said piston member performs said pendular movement during the operation of said crank drive; and sealing means interposed between said piston member and said internal surface and including at least one resilient sealing element having a substantially radially extending supporting section at least partially mounted on said piston member, at least one lip section having a substantially constant thickness and being urged into uninterrupted sealing contact with said internal surface during each stage of pendular movement of the piston member solely by the resiliency of the material of said sealing element, and a third section between and integral with said supporting and lip sections, said third section mounting said lip section on said supporting section for ready tiliting relative thereto and having a groove therein which extends circumferentially of said sealing element between said supporting section and said lip section to facilitate tilting of said lip section relative to said supporting section in accordance with the geometry of pendular movement of said piston member, said supporting section projecting radially outwardly beyond said piston member and having a thickness exceeding that of said lip section to guide said piston member in said bore and to maintain the piston member out of contact with said internal regardless of the extent of wear upon said lip section.

2. The pump as defined in claim 1, wherein the maximum wall thickness of said lip section is substantially 0.6 millimeter.

3. The pump as defined in claim 1, wherein said sealing element has a substantially cup-shaped configuration.

4. The pump as defined in claim 1, wherein said housing member includes a main portion and a cover portion connected to said main portion and at least partially bounding said pumping chamber, said cover portion being detachable from said main portion of said housing member for providing access to said sealing means for replacement of the same.

5. The pump as defined in claim 1, wherein said sealing element further comprises a second lip section, said lip sections extending from said supporting section in opposite directions as considered axially of said cylinder bore.

6. The pump as defined in claim 1, wherein said piston member is arranged to perform alternating suction and pressure strokes and further comprising valve means for closing said fluid inlet means during each pressure stroke and for closing said fluid outlet means diring each suction stroke of said piston member.

7. The pump as defined in claim 1, wherein said piston member includes a support portion situated at the opposite side of said sealing means from said pumping chamber and supporting said sealing means on said piston member, and a confining portion situated in said pumping chamber and confining said sealing means between itself and said support portion.

8. The pump as defined in claim 7, wherein said support portion of said piston member has a diameter exceeding that of said confining portion.

9. The pump as defined in claim 1, wherein said sealing means comprises two sealing elements each of which has a supporting section, a lip section, a third section and a groove in the respective third section, the supporting sections of said sealing elements being adjacent to each other and the lip sections of said sealing elements extending in the opposite directions as considered axially of said cylinder bore.

10. The pump as defined in claim 9, wherein said sealing elements have identical dimensions.

11. The pump as defined in claim 9, wherein said lip sections and said internal surface define a sealed compartment.

* * * * *